US011228846B2

(12) United States Patent
Ow et al.

(10) Patent No.: US 11,228,846 B2
(45) Date of Patent: Jan. 18, 2022

(54) SENSOR ASSEMBLY FOR ELECTRONIC DEVICE

(71) Applicant: Apple Inc., Cupertino, CA (US)

(72) Inventors: Florence W. Ow, Los Altos Hills, CA (US); Peter C. Hrudey, San Mateo, CA (US); Yu-Chun Hsu, San Jose, CA (US); Anthony D. Minervini, Sunnyvale, CA (US); John K. Queeney, San Jose, CA (US); Tavys Q. Ashcroft, San Jose, CA (US)

(73) Assignee: Apple Inc., Cupertino, CA (US)

( * ) Notice: Subject to any disclaimer, the term of this patent is extended or adjusted under 35 U.S.C. 154(b) by 13 days.

(21) Appl. No.: 16/792,043

(22) Filed: Feb. 14, 2020

(65) Prior Publication Data

US 2021/0258698 A1 Aug. 19, 2021

(51) Int. Cl.

| | |
|---|---|
| ***H04R 19/04*** | (2006.01) |
| ***H04R 1/04*** | (2006.01) |
| ***H04R 7/16*** | (2006.01) |
| ***H04R 7/04*** | (2006.01) |

(52) U.S. Cl.

CPC ..... *H04R 19/04* (2013.01); *H04R 1/04* (2013.01); *H04R 7/04* (2013.01); *H04R 7/16* (2013.01); *H04R 2201/003* (2013.01)

(58) Field of Classification Search

CPC . H04R 19/04; H04R 1/04; H04R 7/04; H04R 31/006; H04R 7/16; H04R 2201/003; H04R 1/44; H04R 7/06; H04R 19/005; H04R 31/003; H04R 2499/11; B81B 7/04; B81B 2201/0242; B81B 2201/0257; B81B 2201/0235; B81B 2201/0264; B81B 2201/0292; B81B 2201/047; B81B 2207/012; B81B 2207/07; B81C 2203/0792

USPC ..... 381/173–176, 150–151

See application file for complete search history.

(56) References Cited

U.S. PATENT DOCUMENTS

2009/0245565 A1* 10/2009 Mittleman ..... H04R 1/025 381/365

2013/0273752 A1 10/2013 Rudisill et al.

2014/0044297 A1* 2/2014 Loeppert ..... H04R 1/086 381/355

(Continued)

*Primary Examiner* — Alexander Krzystan

*Assistant Examiner* — Julie X Dang

(74) *Attorney, Agent, or Firm* — Morgan, Lewis & Bockius LLP

(57) ABSTRACT

Aspects of the subject technology relate to low noise microphone assemblies for electronic devices. A microphone assembly may include components for sensing sound, mounted on a substrate, under a cover disposed on the substrate. The components may receive sound through an opening in the substrate. The microphone assembly may include an interposer on the substrate. The interposer includes one or more contacts on a surface that is spatially separated from the surface of the substrate, in a direction perpendicular to the surface of the substrate. A first side of the substrate may be mounted to an inner surface of a housing of the electronic device. The components, the cover, and the interposer may be mounted to an opposing second side of the substrate. A flexible printed circuit may be coupled to the contacts on the surface of the interposer, and mechanically attached to a surface of the cover.

21 Claims, 9 Drawing Sheets

(56) References Cited

U.S. PATENT DOCUMENTS

| | | | | |
|---|---|---|---|---|
| 2014/0112510 | A1* | 4/2014 | Yang | H04R 1/021 381/332 |
| 2015/0237431 | A1* | 8/2015 | Jeziorek | H04R 1/086 381/361 |
| 2017/0164107 | A1* | 6/2017 | Murgia | H04R 3/005 |
| 2017/0186739 | A1 | 6/2017 | Budd et al. | |
| 2017/0318396 | A1* | 11/2017 | Brioschi | H04R 31/003 |
| 2017/0364726 | A1 | 12/2017 | Buchan et al. | |
| 2018/0063645 | A1* | 3/2018 | Yeh | H04R 19/005 |

* cited by examiner

SENSOR ASSEMBLY FOR ELECTRONIC DEVICE

TECHNICAL FIELD

The present description relates generally to electronic devices, and more particularly, but not exclusively, to sensors for electronic devices.

BACKGROUND

Electronic devices such as computers, media players, cellular telephones, and other electronic equipment are often provided with acoustic components such as microphones. It can be challenging to integrate acoustic components into electronic devices, such as in compact devices including portable electronic devices.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
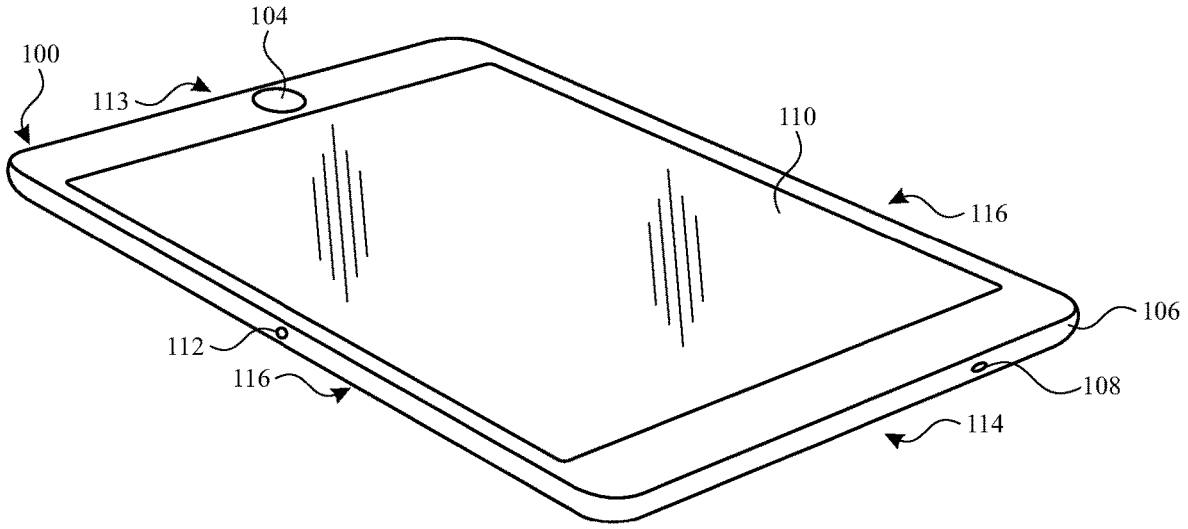
FIG. 1 illustrates a perspective view of an example electronic device having a sensor in accordance with various aspects of the subject technology.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

Electronic devices such as desktop computers, televisions, set top boxes, internet-of-things (IoT) devices, and portable electronic devices including a mobile phones, portable music players, smart watches, tablet computers, smart speakers, remote controllers for other electronic devices, and laptop computers often include one or more sensors that communicate with air (e.g., from outside a housing of the device) to transduce a signal, and/or one or more components such as speakers that move air based on received signals. The sensors that communicate with air can include acoustic sensors, which may include microphones for sound input to the device, one or more pressure sensors, and/or one or more ultrasonic sensors.

For example, a sensor such a pressure sensor, an acoustic sensor, an ultrasonic sensor, or any combination thereof, may be disposed within the housing of the electronic device and configured to receive input from outside the housing, in part due to airflow from outside the housing into the housing at various openings or ports.

In accordance with various aspects of the subject disclosure, an electronic device includes an acoustic component such as a speaker, and/or a sensor such as a pressure sensor, a microphone, an ultrasonic sensor, or any combination thereof. The acoustic component and/or sensor is disposed within a portion of a housing of the electronic device near a port that allows air and/or sound to pass into and/or out of the housing. The port may be an open port or may be covered or partially covered with a membrane or a mesh structure that is permeable to sound and air.

In accordance with aspects of the subject disclosure, a sensor assembly may include an a sensor element and/or sensor circuitry (for processing signals such as pressure signals, acoustic signals, and/or ultrasonic signals received by the sensor element) under a can (also referred to herein as a cover) on a substrate. The substrate may be a printed circuit board substrate on which the sensor element and the sensor circuitry are mounted. The substrate of the sensor assembly may have a shelf that extends beyond the cover along one side of the cover (e.g., along only one side) on which one or more electrical contacts are provided. The electrical contacts may be electrically coupled to conductive traces on or within the substrate running between the electrical contacts and the sensor circuitry. The sensor assembly may include an interposer that raises the electrical contacts from the surface of substrate (e.g., from the shelf) to a cover side (e.g., a rear or interior side) of the component.

By providing an interposer on the sensor circuit board that moves the electrical contacts for a flex connection from the substrate to the cover side of the sensor assembly, the need for substrate area to accommodate the flex connection (e.g., on multiple sides of the cover) is reduced or eliminated. This allows the cover to extend over a larger area of the substrate. The larger cover provides a larger back chamber for the sensor element than in conventional microphones in which the electrical contacts for the microphone are provided on a front surface of a printed circuit board requiring an area on the printed circuit board for connection to a flex circuit. With the larger back chamber facilitated by the interposer and the larger cover, the disclosed sensor assembly can provide improved noise performance while also facilitating implementation in a compact space within a device housing.

Providing a sensor assembly with an interposer as disclosed herein may also facilitate a more reliable, efficient, and cost-effective flex circuit connection to the sensor assembly, as described in further detail hereinafter. The sensor assembly having an interposer as described herein may facilitate implementation of the sensor along a top or bottom edge of a device housing (e.g., adjacent to another component such as a speaker, a camera, or an antenna, that prevents a flex connection to the sensor that exits the sensor along a side of the component). A sensor assembly is also disclosed that includes a substrate having a shelf without an interposer, that may be suitable for implementation along a side of a device housing where additional space may be available for attaching a flex circuit directly to a sensor substrate without an interposer, the flex circuit exiting from the side of the component.

An illustrative electronic device including a sensor assembly such as a microphone assembly, a pressure sensor assembly, and/or an ultrasonic sensor assembly is shown in FIG. 1. In the example of FIG. 1, device 100 (e.g., an electronic device) has been implemented using a housing that is sufficiently small to be portable and carried by a user (e.g., device 100 of FIG. 1 may be a handheld electronic device such as a tablet computer or a cellular telephone or smart phone). As shown in FIG. 1, device 100 includes a display such as display 110 mounted on the front of housing 106. Device 100 includes one or more input/output devices such as a touch screen incorporated into display 110, a virtual or mechanical button or switch such as button 104, and/or other input output components disposed on or behind display 110 or on or behind other portions of housing 106. Display 110 and/or housing 106 include one or more openings to accommodate button 104, a speaker, a light source, a microphone, and/or a camera.

In the example of FIG. 1, housing 106 includes an opening 108 on a top edge 114 of housing 106. In this example, opening 108 forms a port for a sensor that interacts or communicates with air from outside of housing 106. For example, opening 108 may form a sensor port for a sensor assembly disposed within housing 106, such as a microphone port for a microphone assembly disposed within housing 106, a pressure sensor port for a pressure sensor assembly disposed within housing 106, and/or an ultrasonic sensor port for an ultrasonic sensor disposed within housing 106. One or more additional openings in housing 106, though not explicitly shown in FIG. 1, may form a speaker port for a speaker disposed within housing 106. In the example of FIG. 1, housing 106 also includes an opening 112 in a sidewall 116. In this example, opening 112 may also form a port for a sensor assembly. For example, opening 112 may form a sensor port for a sensor assembly disposed within housing 106, such as a microphone port for a microphone assembly disposed within housing 106, a pressure sensor port for a pressure sensor assembly disposed within housing 106, and/or an ultrasonic sensor port for an ultrasonic sensor disposed within housing 106.

Openings 108 and/or 112 may be open ports or may be completely or partially covered with an air-permeable membrane and/or a mesh structure that allow air and sound to pass through the openings. Although two openings 108 and 112 are shown in FIG. 1, this is merely illustrative. One opening 108, two openings 108, or more than two openings 108 may be provided on the top edge 114 and/or the bottom edge 113 of housing 106, and/or one or more openings 112 may be formed on sidewall 116 and/or another sidewall 116 (e.g., a left or right sidewall). Although openings 108 and 112 are depicted, in FIG. 1, on the top edge 114 and sidewall 116 of housing 106, one or more additional openings for acoustic components and/or sensors may be formed on a rear surface of housing 106 and/or a front surface of housing 106 or display 110. In some implementations, one or more groups of openings 108 in housing 106 may be aligned with a single port of an acoustic component and/or a sensor within housing 106.

Housing 106, which may sometimes be referred to as a case, may be formed of plastic, glass, ceramics, fiber composites, metal (e.g., stainless steel, aluminum, etc.), other suitable materials, or a combination of any two or more of these materials. In one example, housing 106 may be formed from a metal peripheral portion that runs (e.g., continuously or in pieces) around the periphery of device 100 to form top edge 114, bottom edge 113, and sidewalls 116 running therebetween, and a metal or glass rear panel mounted to the metal peripheral portion. In this example, an enclosure may be formed by the metal peripheral portion, the rear panel, and display 110, and device circuitry such as a battery, one or more processors, memory, application specific integrated circuits, sensors, antennas, acoustic components, and the like are housed within this enclosure.

However, it should be appreciated that the configuration of device 100 of FIG. 1 is merely illustrative. In other implementations, device 100 may be a computer such as a computer that is integrated into a display such as a computer monitor, a laptop computer, a somewhat smaller portable device such as a smart watch, a pendant device, or other wearable or miniature device, a media player, a gaming device, a navigation device, a computer monitor, a television, a headphone, or other electronic equipment.

For example, in some implementations, housing 106 may be formed using a unibody configuration in which some or all of housing 106 is machined or molded as a single structure or may be formed using multiple structures (e.g., an internal frame structure, one or more structures that form exterior housing surfaces, etc.). Although housing 106 of FIG. 1 is shown as a single structure, housing 106 may have multiple parts. For example, in other implementations, housing 106 may have upper portion and lower portion coupled to the upper portion using a hinge that allows the upper portion to rotate about a rotational axis relative to the lower portion. A keyboard such as a QWERTY keyboard and a touch pad may be mounted in the lower housing portion, in some implementations.

In some implementations, device 100 may be provided in the form of a computer integrated into a computer monitor and/or other display, such as a television. Display 110 may be mounted on a front surface of housing 106 and optionally a stand may be provided to support housing 106 (e.g., on a desktop) and/or housing 106 may be mounted on a surface, such as a wall.

In some implementations, device 100 may be provided in the form of a wearable device such as a smart watch. For example, in some implementations, housing 106 may include one or more interfaces for mechanically coupling housing 106 to a strap or other structure for securing housing 106 to a wearer. In some implementations device 100 may be a mechanical or other non-electronic device in which a microphone can be mounted within the housing, such as a pen or a support structure such as a monitor stand for a computer monitor. In any of these exemplary implementations, housing 106 includes an opening 108 associated with a microphone assembly.

A sensor assembly disposed within housing 106 receives air and/or sound through at least one associated opening 108. An sensor membrane such as a microphone membrane, a pressure sensor membrane, and/or an ultrasonic sensor membrane is located in a portion of housing 106 that receives a flow of air from an exterior or ambient environment.

Figure 2:
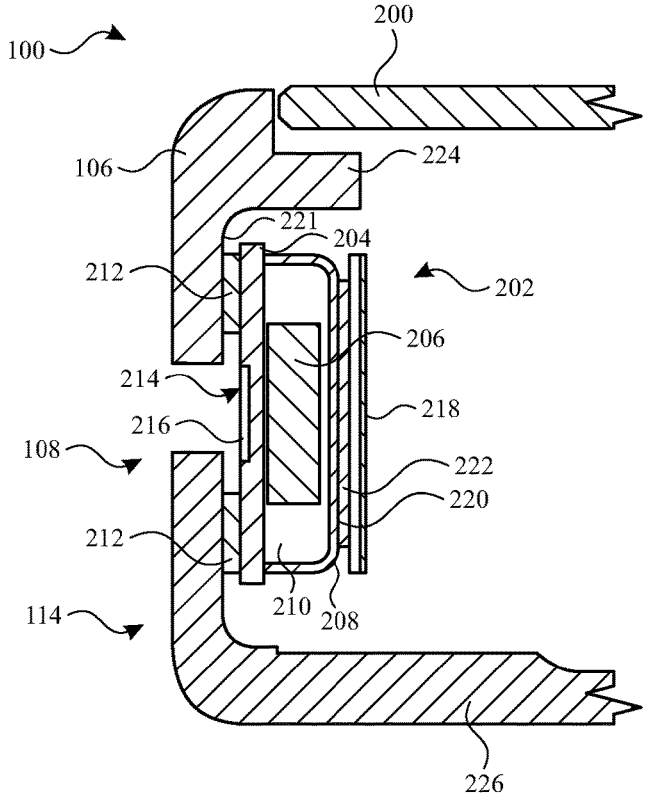
FIG. 2 illustrates a cross-sectional view of a portion of an electronic device including a sensor assembly adjacent to an opening in a housing of the device in accordance with various aspects of the subject technology.

FIG. 2 shows a cross-sectional view of a portion of device 100 in which a sensor assembly is mounted. For illustrative purposes, the sensor assembly is described herein in as being implemented as a microphone assembly 202. However, it should be appreciated that the microphone assembly 202 can be operable as a pressure sensor assembly and/or an ultrasonic sensor assembly by outputting signals responsive to DC movements (e.g., by air) of a sensor membrane therein (e.g., for pressure sensing) and/or outputting signals responsive to sensor membrane vibrations with a frequency greater than 20 kilohertz (e.g., responsive to air vibrations with a frequency greater than 20 kilohertz).

In the example of FIG. 2, device 100 includes a sensor assembly implemented as a microphone assembly 202 mounted within housing 106, adjacent to and aligned with an opening 108 in top edge 114. In this example, microphone assembly 202 is mounted to an interior surface 221 of housing 106 along top edge 114, within an enclosure formed by: top edge 114, rear panel 226 of housing 106 (e.g., rear panel formed from metal, glass, plastic, ceramics and/or other materials), front panel 200 (e.g., a glass outer layer of display 110), and sidewalls 116 and bottom edge 113 which are not visible in FIG. 2. In the example of FIG. 2, microphone assembly 202 is mounted between a ledge 224 of housing 106 and rear panel 226, ledge 224 supporting front panel 200. In implementations in which rear panel 226 is formed from a separate panel (e.g., a separate glass or plastic rear panel rather than from a contiguous continuation of the edge of housing 106 as in FIG. 2), a second ledge, opposite to ledge 224 on the other side of microphone assembly 202, may be provided on top edge 114 to support the rear panel.

As shown, microphone assembly 202 may include a substrate 204 (e.g., a printed circuit board) attached to interior surface 221 by adhesive 212. Adhesive 212 may be, for example, a sealing pressure sensitive adhesive (PSA) that attaches substrate 204 to interior surface 221 such that the mounting interface is sealed against ingress of moisture or other contaminants into housing 106. An opening 214 in substrate 204 is aligned with opening 108 in housing 106 to allow air and sound to pass from the exterior of housing 106 to an sensor element 206 mounted on substrate 204. In this way, sensor element 206 is in fluid communication with opening 214 in substrate 204 (and with opening 108). Sensor element 206 may be, for example, a microelectromechanical systems (MEMS) microphone having a moveable or flexible membrane that, when moved or flexed by incoming sound, causes the MEMS microphone to generate electrical signals corresponding to the incoming sound.

As shown in FIG. 2, the sensor element 206 of microphone assembly 202 is disposed under a cover 208 (sometimes referred to as a can or a shield can) mounted on substrate 204 over the sensor element 206. In this configuration, a cavity formed between substrate 204 and cover 208 defines a back chamber 210 of sensor element 206. In the configuration shown in FIG. 2, a flexible printed circuit 218 is attached to a surface 220 of cover 208 by an adhesive 222. Flexible printed circuit 218, sometimes referred to as a flex circuit, may include one more conductive traces on or within a flexible substrate such as a polyimide substrate. Adhesive 222 may be, for example, surface mount (SMT) glue such as a thermo-setting epoxy adhesive. FIG. 2 also shows how an environmental barrier 216 may be provided that spans opening 214 in substrate 204 to prevent ingress of moisture or other contaminants into microphone assembly 202.

Figure 3:
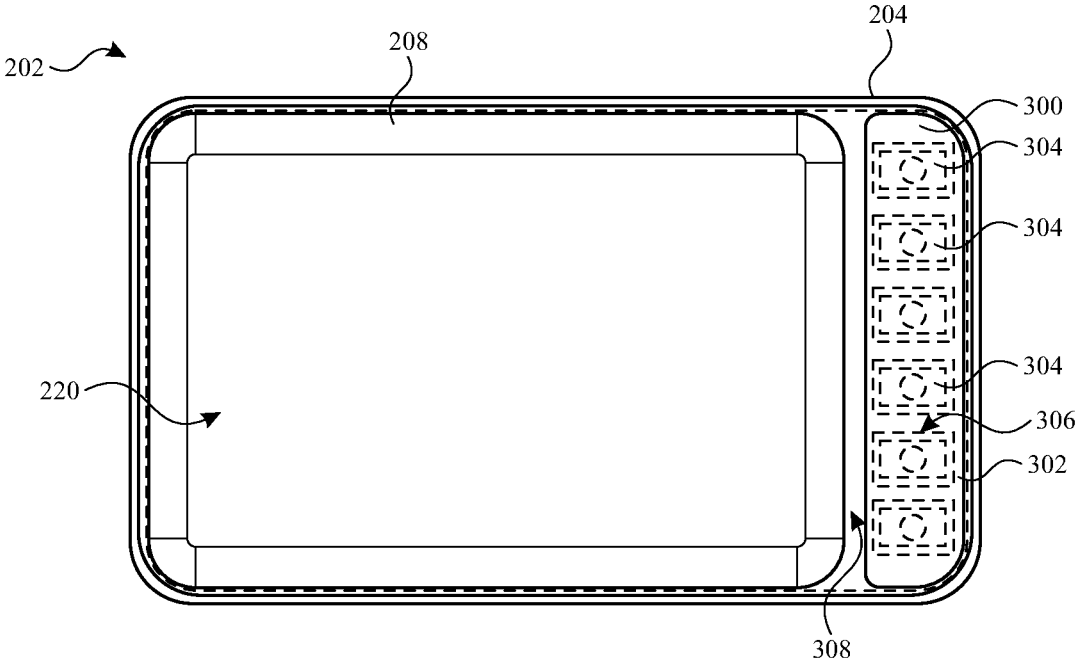
FIG. 3 illustrates a rear view of a sensor assembly in accordance with various aspects of the subject technology.

FIGS. 3-8 show various views of microphone assembly 202 to illustrate other features of the assembly. For example, FIG. 3 illustrates a rear view of microphone assembly 202 in which surface 220 (e.g., a rear surface) of cover 208 is shown without flexible printed circuit 218 attached thereto. The rear view of FIG. 3 also shows how microphone assembly 202 can include an interposer 300 mounted to substrate 204. In the example of FIG. 3, interposer 300 includes an interposer body 302 that has a surface 306 (e.g., a rear surface), and an elongate dimension that extends along one sidewall (e.g., an outer sidewall 308) of cover 208 in a direction that is parallel to the surface of the substrate. Surface 306 of interposer 300 includes electrical contacts 304 that are spaced apart along the elongate dimension of interposer body 302.

Figure 4:
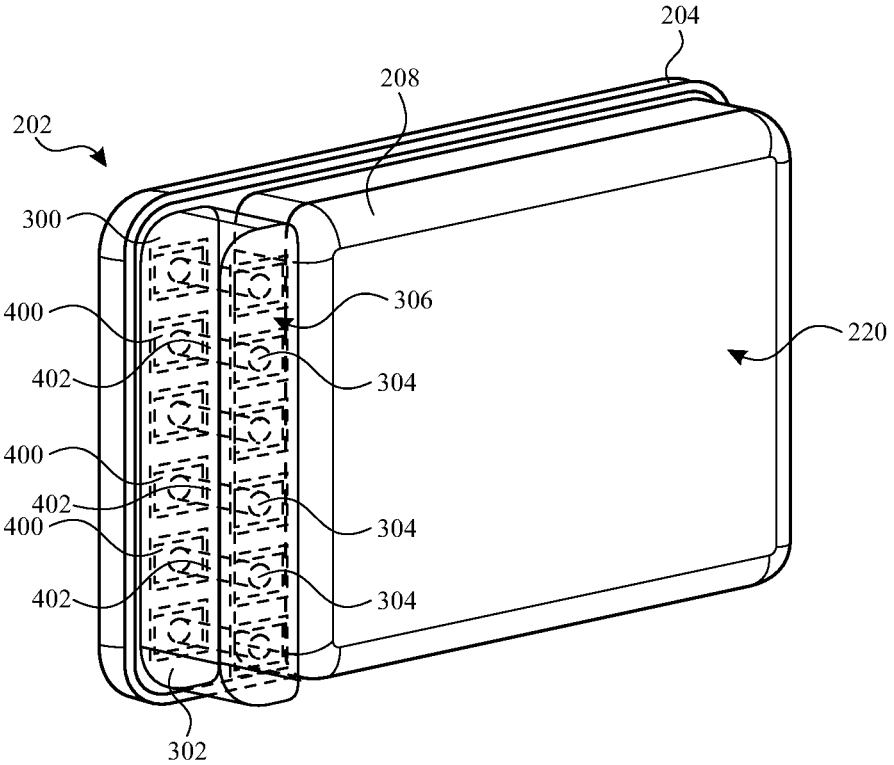
FIG. 4 illustrates a rear perspective view of a sensor assembly in accordance with various aspects of the subject technology.

FIG. 4 illustrates a rear perspective view of microphone assembly 202 with a view of interposer 300. In this example, interposer 300 is shown in partial transparency so that electrical contacts 400 on substrate 204 can be seen. As described in further detail in connection with, for example, FIG. 9, electrical contacts 400 may be coupled to sensor circuitry for microphone assembly 202 by one or more conductive traces on or within substrate 204.

Interposer 300 is mounted on the surface of substrate 204 and has a surface 306 that is spaced apart from the surface of the substrate 204 and includes electrical contacts 304 coupled to the plurality of conductive traces in substrate 204. For example, interposer 300 may include electrical connections such as conductive vias 402 that are electrically coupled to the plurality of conductive traces (e.g., via electrical contacts 400) and that each extend, perpendicularly to the surface of substrate 204, between (e.g., electrical contacts 400 on) the surface of the substrate 204 and a corresponding one of the electrical contacts 304 on the surface of the interposer.

Although conductive vias 402 that extend through interposer body 302 are shown in FIG. 3, it should be appreciated that other conductive structures may be used to connect electrical contacts 304 on surface 306 to electrical contacts 400 on the surface of substrate 204 (e.g., conductive traces running on or within interposer 300). In the examples of FIGS. 3 and 4, interposer 300 includes six electrical contacts 304 and six corresponding conductive vias 402. However, it should also be appreciated that more or fewer than six contacts and vias can be provided as needed.

In the example of FIGS. 3 and 4, conductive vias 402 extend through interposer body 302 (e.g., in a direction substantially perpendicular to the surface of substrate 204) to couple electrical contacts 400 on substrate 204 to electrical contacts 304 on interposer 300, and electrical contacts 304 on interposer 300 are spatially separated from the surface of substrate 204 in a direction perpendicular to the surface of the substrate. In this way, interposer 300 provides a raised connection surface (e.g., surface 306) for electrically coupling flexible printed circuit 218 (see FIG. 2) to microphone assembly 202. This arrangement allows flexible printed circuit 218 to be mechanically attached to surface 220 of cover 208, and to receive signals from microphone assembly 202 without being required to directly access substrate 204, which would require a more complex flexible circuit arrangement that could stress the flexible printed circuit over time, and/or require additional space within housing 106 to accommodate the flex circuit.

Figure 5:
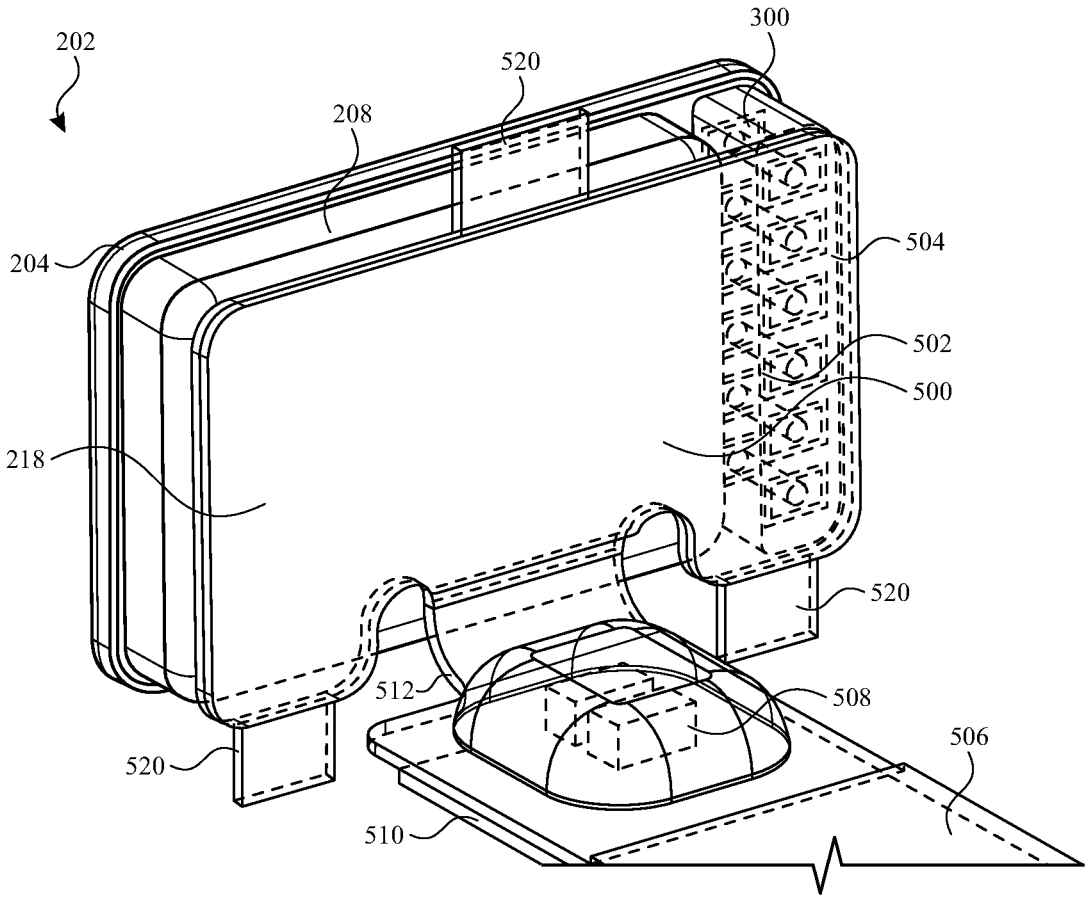
FIG. 5 illustrates a rear perspective view of a sensor assembly coupled to processing circuitry of an electronic device by a flexible printed circuit in accordance with various aspects of the subject technology.

FIG. 5 illustrates a rear perspective view of microphone assembly 202 with flexible printed circuit 218 mechanically attached to surface 220 of cover 208 and electrically coupled to interposer 300. As shown in FIG. 5, providing microphone assembly 202 with an interposer 300 that provides a raised connection surface (e.g., surface 306) for flexible printed circuit 218 on the rear side of microphone assembly 202, facilitates implementation of flexible printed circuit 218 with a bend portion 512 having a single bend between the portion of the flexible printed circuit that is attached to microphone assembly 202 and the portion of the flexible printed circuit that is attached to processing circuitry of device 100. The processing circuitry may include one or more general processors (e.g., a central processing unit) of device 100 on a main circuit board of the device to which flexible printed circuit 218 is attached, and/or processing circuitry 508 mounted to the flexible printed circuit.

The processing circuitry (e.g., processing circuitry 508 and/or other processing circuitry of the device) is disposed within housing 106 for operation of device 100. Flexible printed circuit 218 is electrically coupled (e.g., with solder or another conductive adhesive) to electrical contacts 304 on surface 306 of interposer 300 and extends from the interposer 300 to the processing circuitry 508 (e.g., via portion 502 that spans a gap between interposer 300 and cover 208, the portion that is attached to surface 220 of cover 208, and a single bend at bend portion 512). In this way, flexible printed circuit 218 is arranged to provide input signals from microphone assembly 202 to device processing circuitry (e.g., processing circuitry 508) and/or control and/or power signals from device processing circuitry (e.g., processing circuitry 508) to microphone assembly 202.

In the arrangement shown in FIG. 5, flexible printed circuit 218 includes a sensor portion 500 that is attached to surface 220 of cover 208, a device portion 506 and extending to the device processing circuitry, and a bend portion 512 having a single bend between the sensor portion 500 and the device portion 506. In the example of FIG. 5 sensor portion 500 is depicted as a first planar portion, and device portion 506 is depicted as a second planar portion that is perpendicular to the first planar portion. However, it should be appreciated that sensor portion 500 and device portion 506 can be non-planar and/or non-perpendicular depending on positioning and attachment constraints within housing 106. As shown device portion 506 may be mounted to a rigid panel 510 such as a stiffening layer, and internal rigid structure within housing 106, or a portion of housing 106. This arrangement, in which flexible printed circuit 218 is provided with a single bend between sensor portion 500 and device portion 506, may help reduce or eliminate strain on adhesive 212 (see FIG. 2) that attaches microphone assembly 202 to housing 106. As shown in the example of FIG. 5, sensor portion 500 extends beyond an edge of the surface 220 (e.g., an outer surface) of the cover 208 to form portion 502, spanning the gap between cover 208 and interposer 300, and portion 504 which extends onto surface 306 of interposer 300. FIG. 5 also shows how flexible printed circuit 218 may include one or more tabs 520 that extend beyond the footprint of microphone assembly 202 (e.g., to allow for removal and/or replacement of microphone assembly 202).

Figure 6:
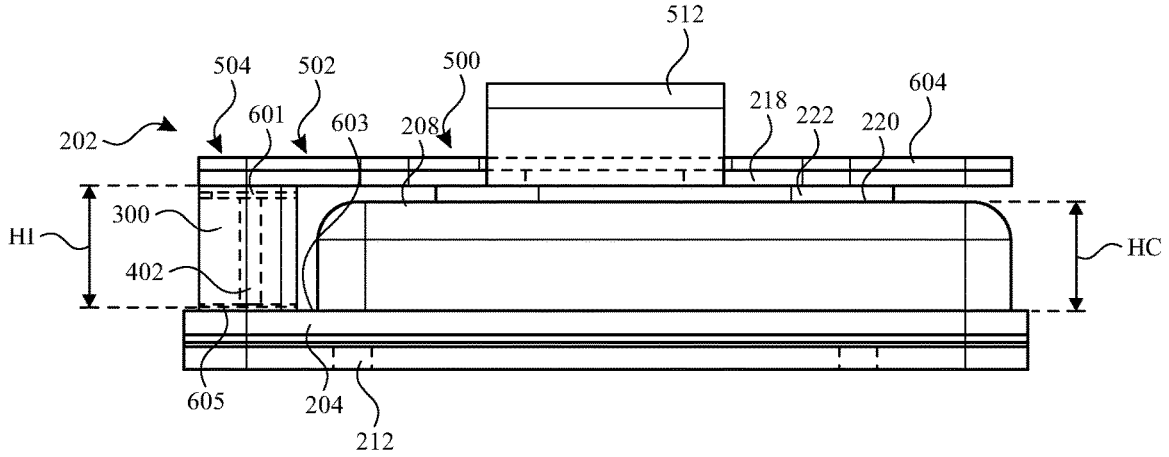
FIG. 6 illustrates a side view of a sensor assembly attached to a flexible printed circuit in accordance with various aspects of the subject technology.
Figure 7:
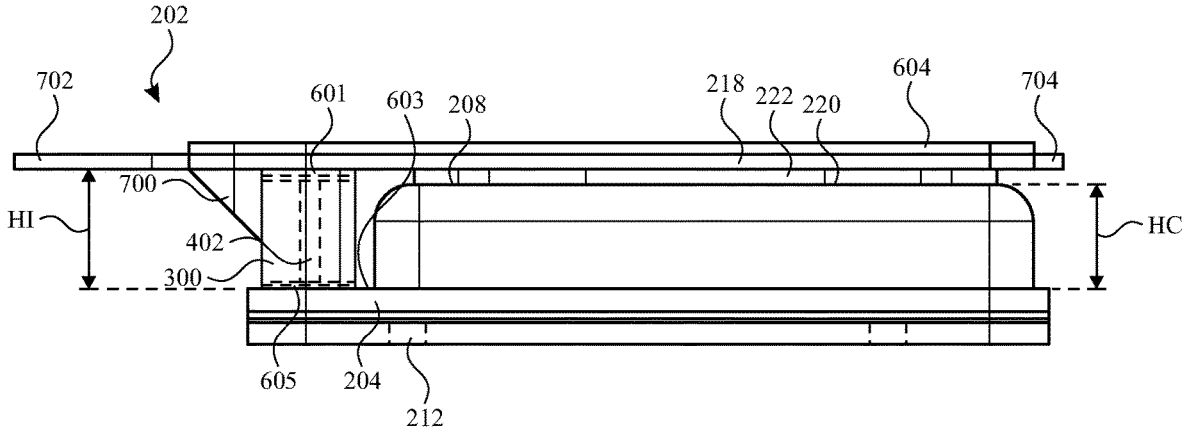
FIG. 7 illustrates a side view of a sensor assembly attached to another flexible printed circuit in accordance with various aspects of the subject technology.

FIG. 6 illustrates a side view of microphone assembly 202 with flexible printed circuit 218 attached to surface 220 of cover 208 by adhesive 222 and to interposer 300 by solder 601. In the side view of FIG. 6, it can be seen that, in some implementations, cover 208 extends perpendicularly from the surface 603 of substrate 204 to a first height HC above the surface 603 of the substrate 204. In this example, interposer 300 extends perpendicularly from the surface 603 of the substrate 204 to a second height HI above the surface 603 of the substrate 204. In this example, the second height HI of interposer 300 is greater than the first height HC of cover 208. That is, interposer 300 in this example is proud of cover 208. In this arrangement, flexible printed circuit 218 can be attached to surface 220 of cover 208 by adhesive 222 and to surface 306 of interposer 300 by solder 601 with portions 500, 502, and 504 in a contiguous and substantially planar configuration, as illustrated in FIG. 6.

In the example of FIG. 6, a polymer layer 604 such as a polyimide layer is provided on portions 500, 502, and 504 of flexible printed circuit 218, and bend portion 512 of flexible printed circuit 218 can be seen curving away from the plane defined by surface 220. FIG. 6 also shows how conductive structures such as conductive vias 402 of interposer 300 extend from a first side to a second side of interposer 300, which is attached respectively to flexible printed circuit 218 by solder 601 and to surface 603 of substrate 204 by solder 605. FIG. 6 also illustrates that electrical contacts 304 on surface 306 of interposer 300 are disposed at the second height HI above surface 603 of substrate 204. Although not explicitly shown in FIG. 6, an opening may be provided in a portion of polymer layer 604 to allow one or more additional components (e.g., circuitry) to be mounted to flexible printed circuit 218 (e.g., on a side of the flexible printed circuit that is opposite to the side attached to surface 220).

In the example of FIGS. 3-6, bend portion 512 extends from sensor portion 500 of flexible printed circuit 218 on a side of microphone assembly 202 that is perpendicular to the side of microphone assembly 202 on which interposer 300 is disposed. However, it should be appreciated that, in some implementations, such as in the example of FIG. 7, the portion of flexible printed circuit 218 that extends from interposer 300 toward processing circuitry 508 (e.g., portion 702 in FIG. 7) can extend from the same side of microphone assembly 202 as the side on which interposer 300 is mounted. In this example, flexible printed circuit 218 can also be provided with a tab 704 on an opposing side of microphone assembly 202, and microphone assembly 202 can be provided with a support structure 700 that partially fills a space between flexible printed circuit 218 and interposer body 302 to support portion 702.

Figure 8:
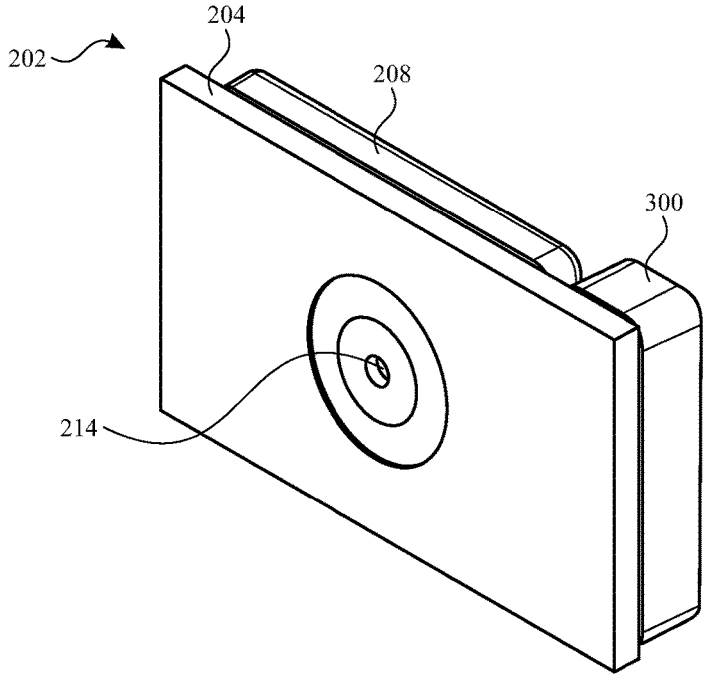
FIG. 8 illustrates a front perspective view of a sensor assembly in accordance with various aspects of the subject technology.

FIG. 8 illustrates a front perspective view of microphone assembly 202 in which opening 214 in substrate 204 can be seen. Opening 214 allows the flow of air, and resultantly sound, into the cavity formed between substrate 204 and cover 208, in which the sensor element 206 is mounted.

Figure 9:
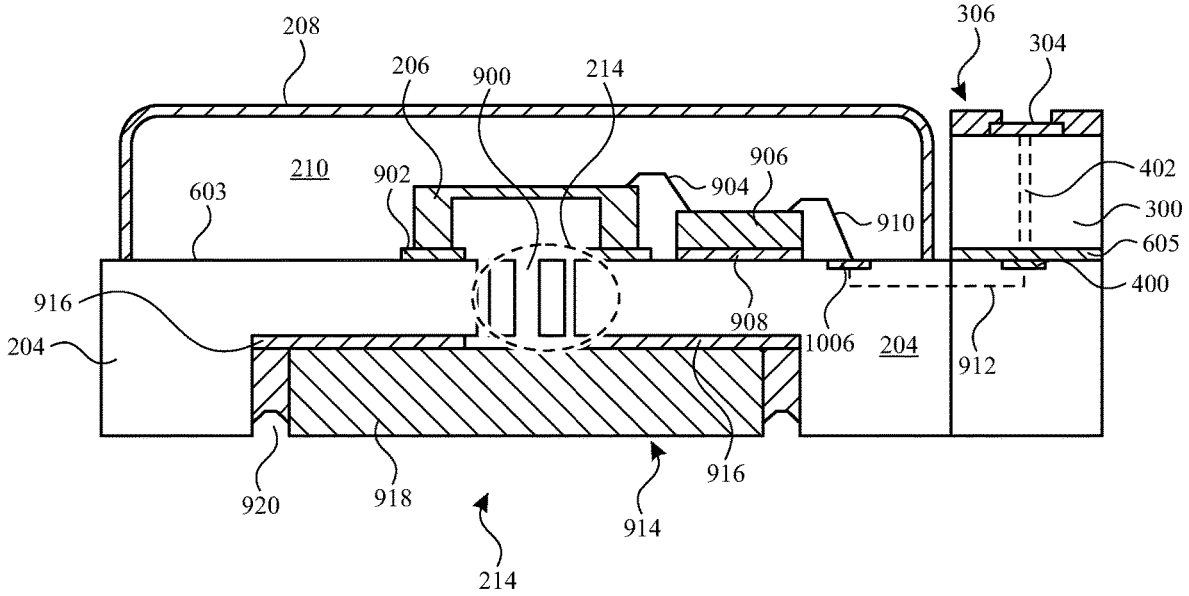
FIG. 9 illustrates a cross-sectional side view of a sensor assembly in accordance with various aspects of the subject technology.

FIG. 9 illustrates schematic a cross-sectional view of microphone assembly 202 showing additional features and/or components that may be included in microphone assembly 202. As shown in FIG. 9, microphone assembly 202 includes sensor circuitry 906, such as an application specific integrated circuit (ASIC) that is mounted to surface 603 of substrate 204 within the back chamber 210 formed by the cavity between surface 603 and cover 208. As shown, sensor circuitry 906 is coupled between sensor element 206 (e.g., a MEMS microphone) and one or more conductive traces 912 on or within substrate 204. Conductive traces 912 extend between electrical contacts 1006 on surface 603 under cover 208 and electrical contacts 400 on surface 603 outside of cover 208.

As shown, electrical contacts 400 are coupled to conductive vias 402 by solder 605, and electrical contacts 304 are coupled to conductive vias 402 and exposed for connection to flexible printed circuit 218 (e.g., by solder 601). In the example of FIG. 9, sensor element 206 is coupled to sensor circuitry 906 by wire bonds 904, and sensor circuitry 906 is coupled to electrical contacts 1006 (and thus to conductive traces 912) by wire bonds 910. Sensor element 206 is in electrical communication with conductive traces 912 on or within substrate 204 (e.g., via wire bonds 904, sensor circuitry 906, wire bonds 910, and electrical contacts 1006). In this example, sensor element 206 is mounted to surface 603 of substrate 204 by adhesive 902 (e.g., a conductive adhesive) and sensor circuitry 906 is mounted to surface 603 of substrate 204 by adhesive 908 (e.g., a conductive adhesive). In this way, interposer 300 is provided with conductive vias 402 that are electrically coupled to conductive traces 912 and that each extend, perpendicularly to the surface 603 of substrate 204, between the surface 603 of the substrate 204 and a corresponding one of the electrical contacts 304 on the surface 306 of the interposer 300. However, it should be appreciated that sensor element 206 and/or sensor circuitry 906 can be electrically coupled together and/or to electrical contacts 400 by one or more additional conductive traces in substrate 204 rather than by wire bonds, in some implementations.

In the example of FIG. 9, microphone assembly 202 also includes an environmental barrier 918 disposed in a recess 914 in substrate 204, spanning opening 214, to prevent ingress of moisture and/or other contaminants into microphone assembly 202. For example, environmental barrier 918 may be an implementation of environmental barrier 216 of FIG. 1.

In the example of FIG. 9, environmental barrier 918 spans opening 214 and is mounted within recess 914 adjacent to a metal layer 916 such as a grounding layer within substrate 204, and a sealing material 920 that seals the space between the outer edges of environmental barrier 918 and the interior edges of recess 914. In this example, opening 214 is formed by multiple openings 900 in substrate 204, however this is merely illustrative and opening 214 may be a single continuous opening.

Environmental barrier 918 may include one or more layers of material that prevent passage of moisture and/or other contaminants. For example, environmental barrier 918 may include a mesh layer that extends over the opening 214 in substrate 204. The mesh layer may be, for example, a metal mesh. Environmental barrier 918 may also, or alternatively, include an environmental barrier membrane that extends over the opening in the substrate. For example, the membrane may be a membrane that prevents passage of moisture (e.g., water or oil) therethrough while allowing passage of air therethrough. Various examples of layers of material that can be included in environmental barrier 918 are described hereinafter in connection with, for example, FIGS. 13-19.

Figure 10:
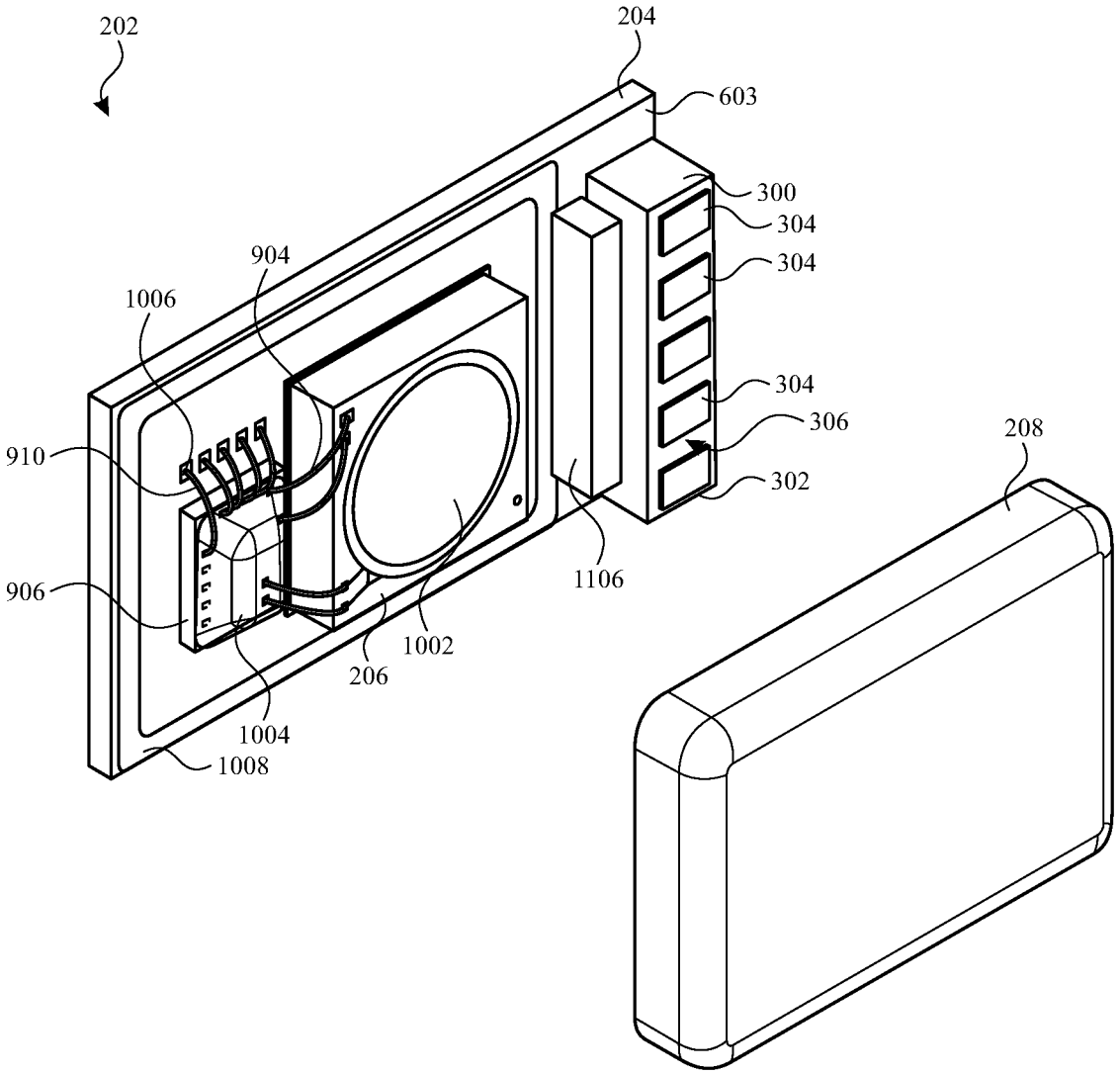
FIG. 10 illustrates a partially exploded rear perspective view of a sensor assembly in accordance with various aspects of the subject technology.

FIG. 10 illustrates a partially exploded perspective view of microphone assembly 202 in which cover 208 is removed from substrate 204. In the example of FIG. 10, sensor element 206 and sensor circuitry 906 can be seen mounted to surface 603 of substrate 204. As shown, a ring of conductive adhesive 1008 (e.g., solder) is provided on surface 603 around sensor element 206 and sensor circuitry 906 in a pattern matching the shape of the edge of cover 208, for mounting the cover 208 to surface 603.

FIG. 10 also shows how sensor circuitry 906 can be covered with an encapsulant 1004 such as a glob top. In the example of FIG. 10, the moveable membrane 1002 of sensor element 206 is also visible, and an adhesive block 1106 can be seen for providing a mechanical attachment between interposer 300 and substrate 204. Although not visible in FIG. 10, sensor element 206 may also include a rigid air-permeable backplate disposed between the moveable membrane and the opening 214 in the substrate 204. When air moves into and/or out of device 100 through opening 108, and/or when sound waves in the air travel into device 100 through opening 108, moveable membrane 1002 moves and/or vibrates correspondingly. The movement and/or vibrations of moveable membrane 1002 cause sensor element 206 to generate sensor signals corresponding to the movement and/or vibrations. In circumstances in which the moveable membrane 1002 moves in a DC fashion due to air moving into or out of the device and thus changing the pressure, the sensor signals may be interpreted by processing circuitry of device 100 as pressure sensor signals. In circumstances in which the moveable membrane 1002 vibrates due to vibrations in the air, the sensor signals may be interpreted by processing circuitry of device 100 as microphone signals if the frequency of the vibration is below 20 kilohertz or as ultrasonic sensor signals if the frequency of the vibration is above 20 kilohertz.

Figure 11:
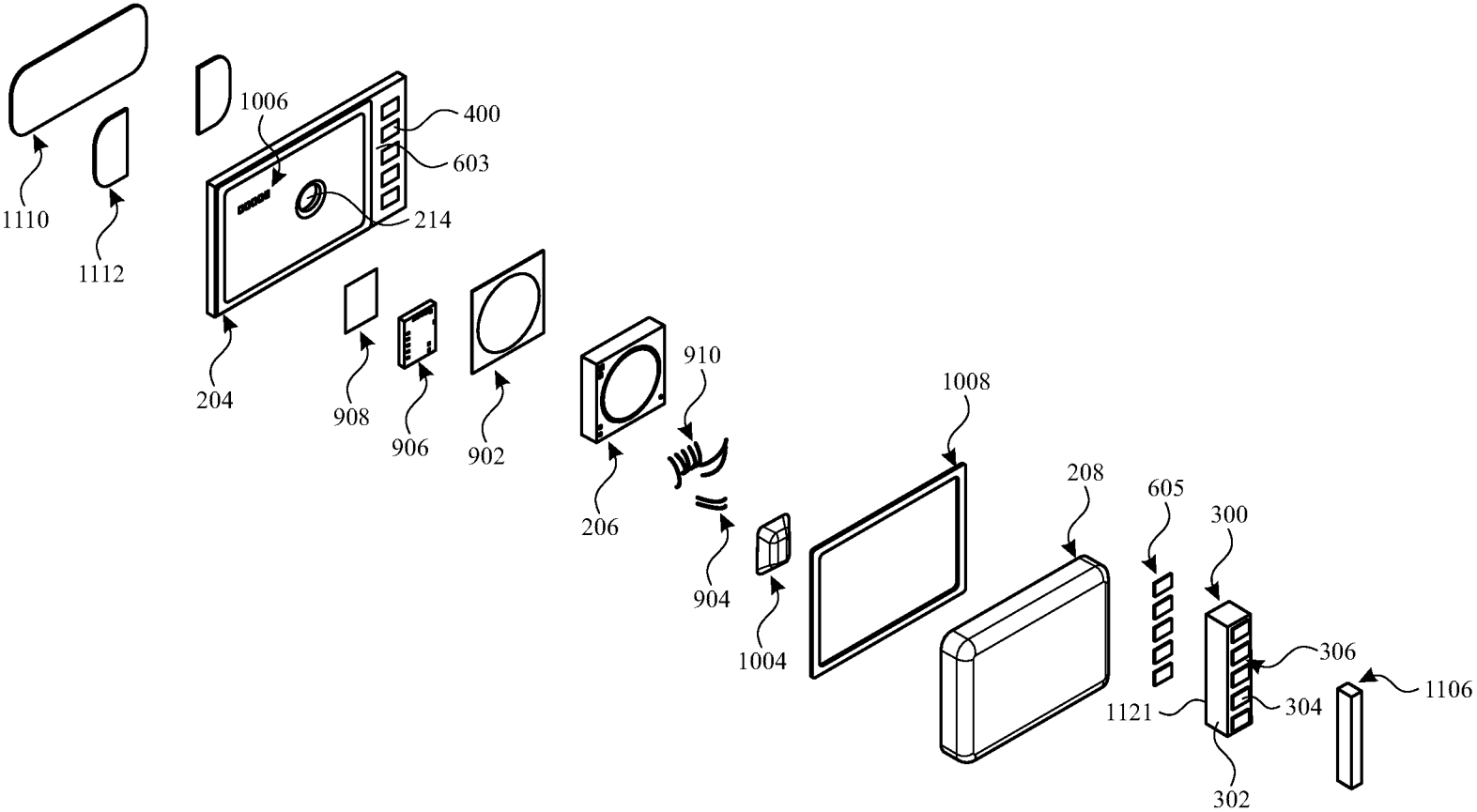
FIG. 11 illustrates an exploded rear perspective view of a sensor assembly in accordance with various aspects of the subject technology.

Additional details of microphone assembly 202 can be seen in the exploded perspective view of FIG. 11. As shown in FIG. 11, microphone assembly 202 may include a mesh layer such as an acoustic mesh 1110 that attaches to substrate 204 by an adhesive 1112 such as a PSA. Acoustic mesh 1110 may be attached to a first side of substrate 204 that is opposite to surface 603. Acoustic mesh 1110 may form a port of environmental barrier 918, and may be mounted to the opposing surface of substrate 204 or within a recess such as recess 914 of FIG. 9. When attached to substrate 204, acoustic mesh 1110 spans opening 214 in substrate 204.

In the exploded view of FIG. 11, electrical contacts 1006 and 400 on surface 603 of substrate 204 can be seen. FIG. 11 also shows adhesive 908 for attaching sensor circuitry 906 to surface 603, and adhesive 902 for attaching sensor element 206 to surface 603. Wire bonds 910 and 904, and encapsulant 1004 are also shown. FIG. 11 also shows how moveable membrane 1002 is disposed in alignment with opening 214 in substrate 204.

FIG. 11 also shows conductive adhesive 1008 for attaching cover 208 to surface 603, and solder 605 arranged to couple electrical contacts 400 on surface 603 to corresponding contacts a surface 1121 of interposer 300. Electrical contacts 304 on surface 306 of interposer 300, and adhesive block 1106 are also shown.

In the examples described above in connection with FIGS. 2-11, microphone assembly 202 is provided with an interposer 300 that provides electrical contacts 304 for coupling to a flexible printed circuit at a height above the surface of substrate 204. This can be particularly useful in mounting microphone assembly 202 along a top edge 114 or a bottom edge 113 of a device such as device 100 (FIG. 1). For example, arrangements of microphone assembly 202 that include an interposer can be helpful in facilitating installation of the microphone assembly adjacent to or between other components such as a camera or a speaker.

Figure 12:
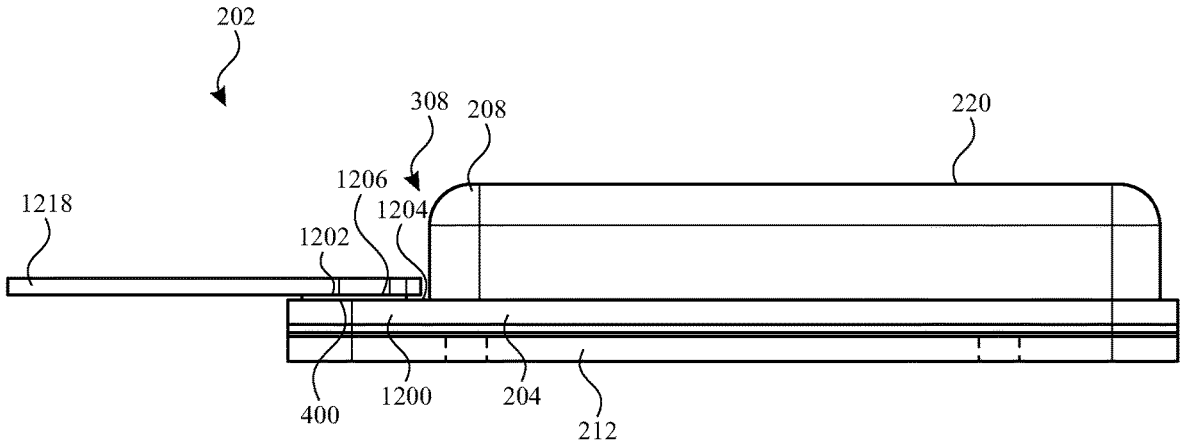
FIG. 12 illustrates side view of another sensor assembly attached to a flexible printed circuit in accordance with various aspects of the subject technology.

However, in some circumstances, microphone assembly 202 may be mounted at a location within a device such as device 100 in which additional space is available along one side of the microphone assembly 202, such as a location along a sidewall 116 of device 100. In such circumstances, microphone assembly 202 can be provided without an interposer, as shown in the example of FIG. 12. In the example of FIG. 12, substrate 204 includes a shelf 1200 that extends beyond the peripheral edge of the cover 208 on one side of the cover (e.g., on the side corresponding to outer sidewall 308). Shelf 1200 is configured for attachment to a flexible printed circuit. For example, as shown in FIG. 12, a flexible printed circuit 1218 may be directly attached to shelf 1200. For example, solder 1206 may couple electrical contacts 400 on surface 1204 of shelf 1200 directly to corresponding contacts on surface 1202 of flexible printed circuit 1218. In this example, electrical contacts 400 on the shelf 1200 are electrically coupled to conductive traces 912 as in the example of FIG. 9

In the example of FIG. 12, shelf 1200 has an elongate dimension that extends in a direction parallel to the one side (e.g., outer sidewall 308) of cover 208 (e.g., a direction into the page in the representation of FIG. 12). Although not visible in FIG. 12, shelf 1200 may include multiple electrical contacts 400 spaced apart along the elongate dimension of the shelf (e.g., as shown in FIG. 11). Microphone assembly 202 in the arrangement of FIG. 12 is configured for installation adjacent to a sidewall 116 of housing 106 of device 100 (e.g., aligned with an opening 112).

FIGS. 13-19 show various examples of layers of materials that may be included in environmental barrier 918, as described in connection with FIG. 9, which may be an implementation of environmental barrier 216 of FIG. 2. The environmental barrier 918 of FIG. 13 may be provided within or over the opening 214 in substrate 204 of any of the examples of FIGS. 2-12.

Figure 13:
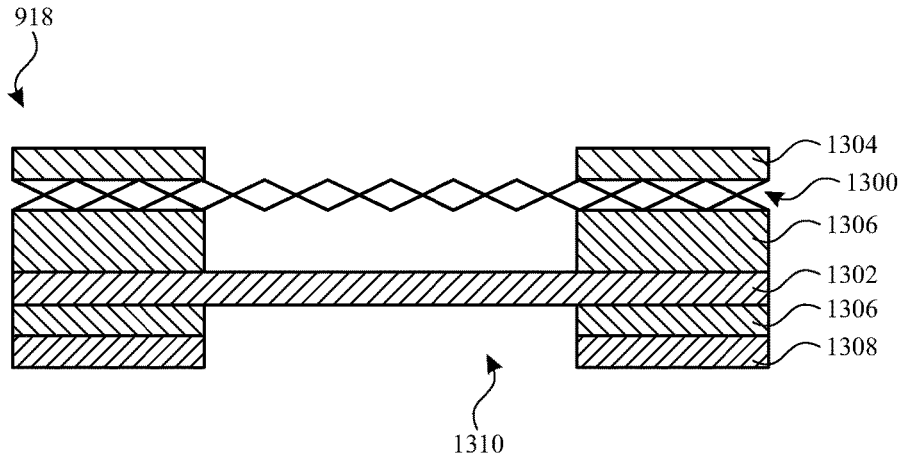
FIG. 13 illustrates a cross-sectional side view of a portion of a sensor assembly having a mesh layer and a moisture barrier for spanning an opening in a substrate in accordance with various aspects of the subject technology.

In the example of FIG. 13, environmental barrier 918 includes a mesh layer 1300 (e.g., an implementation of acoustic mesh 1110 of FIG. 11) that may be attached to substrate 204 (e.g., within a recess 914) by a layer of conductive adhesive 1304 (e.g., an implementation of adhesive 1112 if FIG. 11). Mesh layer 1300 may, for example, be a calendared mesh of wires having a diameter of between 50 microns and 100 microns, and apertures in the mesh of between 50 microns and 150 microns. Mesh layer may be formed from one or more metals such as stainless steel. Conductive adhesive 1304 may, for example, be a heat-activated conductive adhesive film.

As shown in FIG. 13, environmental barrier 918 may include additional layers such as one or more layers of adhesive 1306 (e.g., an insulating heat-activated films (HAF)) between mesh layer 1300, and a membrane 1302 that functions as a moisture barrier (e.g., a water barrier) that allows passage of air therethrough. For example, membrane 1302 may be a polymer membrane such as a membrane formed form polytetrafluoroethylene.

Mesh layer 1300 and membrane 1302 span, or extend over, an opening 1310 in the environmental barrier 918 that is arranged to be co-aligned with opening 214 in substrate 204, so that mesh layer 1300 and 1302 span, or extend across opening 214. As shown, conductive adhesive 1304 and the layers of adhesive 1306 have openings that partially define opening 1310. In the example of FIG. 13, environmental barrier 918 also includes an additional layer of adhesive 1306 on an opposing side of membrane 1302, and a stiffener layer 1308 attached to membrane 1302 by the additional layer of adhesive 1306. Stiffener layer 1308 may be, for example, a polyimide layer. As shown, the additional layer of adhesive 1306 and stiffener layer 1308 each include a co-aligned opening that further partially define opening 1310.

Environmental barrier 918 of FIG. 13 may be provided in a recess 914 in substrate 204 such that conductive adhesive 1304 attaches the environmental barrier 918 to substrate 204 (e.g., in contact with a grounding layer such as metal layer 916 of FIG. 9), such that stiffener layer 1308 forms an outermost layer of environmental barrier 918.

Figure 14:
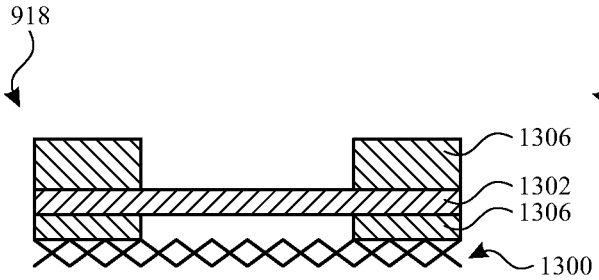
FIG. 14 illustrates a cross-sectional side view of a portion of another sensor assembly having a mesh layer and a moisture barrier for spanning an opening in a substrate in accordance with various aspects of the subject technology.

FIG. 14 illustrates another implementation of environmental barrier 918 that may be provided in the opening 214 of substrate 204 in any of the examples of FIGS. 1-12. In the example of FIG. 14, mesh layer 1300 is arranged as the outermost layer of environmental barrier 918, attached to membrane 1302 by a layer of adhesive 1306 (e.g., a HAF layer), which is arranged to be attached to substrate 204 by additional layers of adhesive 1306. In this example, membrane 1302 is disposed between sensor element 206 and mesh layer 1300.

Figure 15:
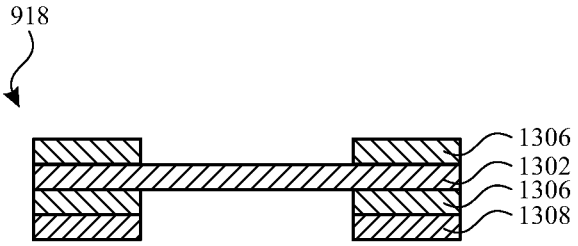
FIG. 15 illustrates a cross-sectional side view of a portion of a sensor assembly having a moisture barrier for spanning an opening in a substrate in accordance with various aspects of the subject technology.

FIG. 15 illustrates another implementation of environmental barrier 918 that may be provided in the opening 214 of substrate 204 in any of the examples of FIGS. 1-12. In the example of FIG. 15, environmental barrier 918 is provided without a mesh layer 1300. In this example, membrane 1302 is configured to be attached to substrate 204 by a layer of adhesive 1306 (e.g., a HAF layer), and a stiffener layer 1308 is attached to membrane 1302 by an additional layer of adhesive 1306.

Figure 16:
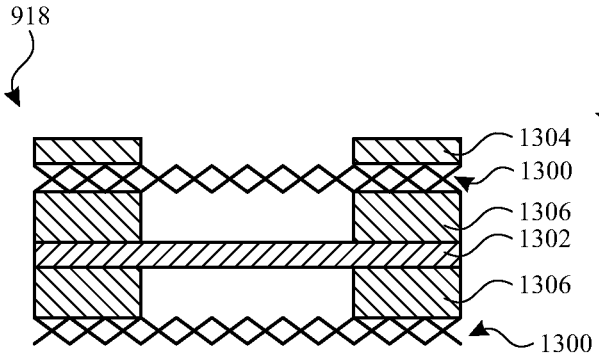
FIG. 16 illustrates a cross-sectional side view of a portion of a sensor assembly having multiple mesh layers and a moisture barrier for spanning an opening in a substrate in accordance with various aspects of the subject technology.

FIG. 16 illustrates another implementation of environmental barrier 918 that may be provided in the opening 214 of substrate 204 in any of the examples of FIGS. 1-12. In the example of FIG. 16, environmental barrier 918 is provided with two mesh layers 1300, disposed on opposing sides of a membrane 1302.

In this example, a mesh layer 1300 (e.g., an implementation of acoustic mesh 1110 of FIG. 11) is provided that may be attached to substrate 204 (e.g., within a recess 914) by a conductive adhesive 1304 (e.g., an implementation of adhesive 1112 if FIG. 11). In this example, environmental barrier 918 may include one or more additional layers of adhesive 1306 between mesh layer 1300 and membrane 1302 that functions as a moisture barrier that allows passage of air therethrough.

In the example of FIG. 16, environmental barrier 918 also includes one or more additional layers of adhesive 1306 on an opposing side of membrane 1302, and an additional mesh layer 1300 attached to membrane 1302 by the additional layer of adhesive 1306. In this arrangement, the additional mesh layer 1300 forms an outermost layer of environmental barrier 918.

Figure 17:
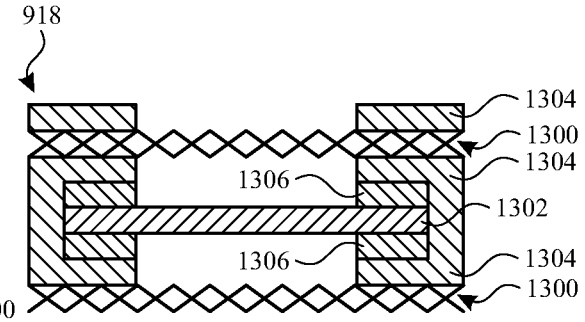
FIG. 17 illustrates a cross-sectional side view of a portion of another sensor assembly having multiple mesh layers and a moisture barrier for spanning an opening in a substrate in accordance with various aspects of the subject technology.

In the example of FIG. 16, mesh layers 1300 are electrically separated by layers of adhesive 1306 and membrane 1302, and the outer mesh layer 1300 is electrically separated from conductive adhesive 1304. However, in other implementations, such as in the example of FIG. 17, the outer mesh layer 1300 may be conductively coupled to the inner mesh layer 1300 and conductive adhesive 1304. In the example of FIG. 17, this conductive coupling is achieved by providing an additional layer of conductive adhesive 1304 on an opposing side of the inner mesh layer 1300, a first layer that includes both adhesive 1306 and conductive adhesive 1304 between the additional layer of conductive adhesive 1304 and membrane 1302, and a second layer that includes both adhesive 1306 and conductive adhesive 1304 between the membrane and a further additional layer of conductive adhesive 1304 that attaches the outer mesh layer 1300 to the environmental barrier 918. In this arrangement, a continuous conductive path is provided between the conductive adhesive 1304 that attaches environmental barrier 918 to substrate 204 and the outer mesh layer 1300.

Figure 18:
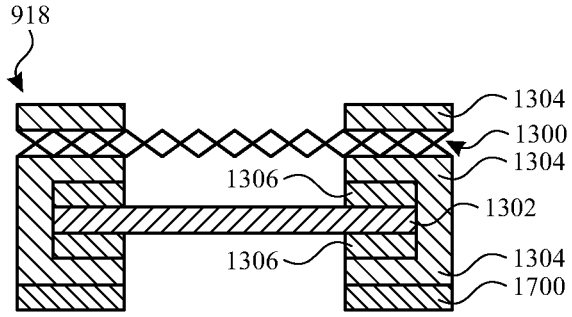
FIG. 18 illustrates a cross-sectional side view of a portion of another sensor assembly a mesh layer and a moisture barrier for spanning an opening in a substrate in accordance with various aspects of the subject technology.

FIG. 18 illustrates another implementation of environmental barrier 918 that may be provided in the opening 214 of substrate 204 in any of the examples of FIGS. 1-12. In the example of FIG. 18, environmental barrier 918 is provided with layers similar to the layers described above in connection with FIG. 17, except that the outer mesh layer 1300 is replaced with a conductive layer 1700 having an opening, co-aligned with the openings in the layers of conductive adhesive 1304 and the layers having both conductive adhesive 1304 and adhesive 1306, that partially defines opening 1310. Conductive layer 1700 may be, for example, a conductive film such as a metal film (e.g., a gold-plated nickel film).

Figure 19:
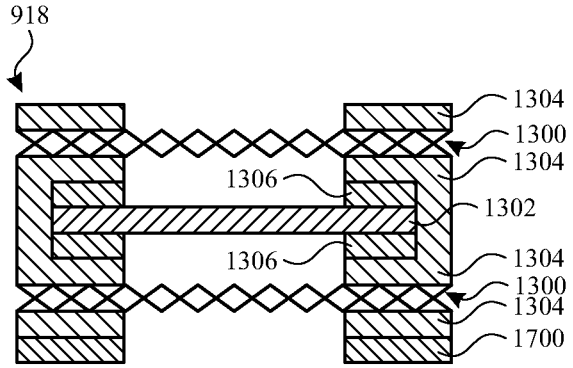
FIG. 19 illustrates a cross-sectional side view of a portion of another sensor assembly having multiple mesh layers and a moisture barrier for spanning an opening in a substrate in accordance with various aspects of the subject technology.

In the example of FIG. 18, conductive layer 1700 is provided instead of the outer mesh layer 1300 shown in FIG. 17. However, in the example of FIG. 19, environmental barrier 918 is provided with a conductive layer 1700 in addition to an outer mesh layer 1300. In this example, outer mesh layer 1300 is conductively coupled to the inner mesh layer 1300 by the layers of conductive adhesive 1304 as in FIG. 17, and an additional layer of conductive adhesive 1304 is provided on an opposing (outer) side of mesh layer 1300. As shown in FIG. 19, conductive layer 1700 may be attached to the outer side of outer mesh layer 1300 by the additional layer of conductive adhesive 1304. In this example, conductive layer 1700 forms an outermost layer of environmental barrier 918.

In operation of device 100, sound generated externally to device 100 may pass into housing 106 via openings 108 or 112, and into microphone assembly 202 by passing through opening 214 in substrate 204 (e.g., through one or more layers of an environmental barrier such as environmental barrier 918 as described herein). The sound that passes into microphone assembly may cause membrane 1002 of sensor element 206 to move. Sensor element 206 may be a MEMS microphone that generates electrical signals corresponding to the movement of membrane 1002.

The electrical signals generated by sensor element 206 may be provided to sensor circuitry 906. Sensor circuitry 906 may digitize, filter, or otherwise process the signals from sensor element 206 before providing the processed signals to device circuitry such as processing circuitry 508 via conductive traces 912 in substrate 204 and flexible printed circuit 218. The device circuitry may process and/or provide the signals from sensor circuitry 906 as audio input, for example, to one or more applications such as recording applications, messaging applications, video conferencing applications, telephony applications, and/or any other applications running on the device circuitry of device 100 that can receive audio input.

In accordance with some aspects of the subject disclosure, a sensor assembly for an electronic device is provided, the sensor assembly includes a substrate having an opening configured for alignment with an opening in a housing of the portable electronic device; a sensor element mounted on a surface of the substrate in fluid communication with the opening in the substrate and in electrical communication with a plurality of conductive traces on or within the substrate; a cover sealingly disposed on the surface of the substrate and defining a back chamber for the sensor element between the cover and the surface of the substrate; and an interposer mounted on the surface of the substrate and having surface that is spaced apart from the surface of the substrate and includes a plurality of electrical contacts coupled to the plurality of conductive traces.

In accordance with other aspects of the subject disclosure, an electronic device is provided that includes a housing; an opening in the housing configured to fluidly couple an environment external to the housing to an interior volume within the housing; and a sensor assembly disposed within the housing. The sensor assembly includes a substrate having an opening that is aligned with the opening in the housing; a sensor element mounted on a surface of the substrate in fluid communication with the opening in the substrate and in electrical communication with a plurality of conductive traces on or within the substrate; a cover sealingly disposed on the surface of the substrate and defining a back chamber for the sensor element between the cover and the surface of the substrate; and an interposer mounted on the surface of the substrate and having surface that is spaced apart from the surface of the substrate and includes a plurality of electrical contacts coupled to the plurality of conductive traces.

In accordance with other aspects of the subject disclosure, a sensor assembly for an electronic device is provided, the sensor assembly including a substrate having an opening configured for alignment with an opening in a housing of the portable electronic device; a sensor element mounted on a surface of the substrate in fluid communication with the opening in the substrate and in electrical communication with a plurality of conductive traces on or within the substrate; and a cover having a peripheral edge that is sealingly disposed on the surface of the substrate and defines a back chamber for the sensor element between the cover and the surface of the substrate. The substrate includes a shelf that extends beyond the peripheral edge of the cover on one side of the cover; and a plurality of electrical contacts on the shelf that are electrically coupled to the plurality of conductive traces.

Various functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "processor", and "memory" all refer to electronic or other technological devices. These terms exclude people or groups of people. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a computer having a display device as described herein for displaying information to the user and a keyboard and a pointing device, such as a mouse or a trackball, by which the user can provide input to the computer. Other kinds of devices can be used to provide for interaction with a user as well; for example, feedback provided to the user can be any form of sensory feedback, such as visual feedback, auditory feedback, or tactile feedback; and input from the user can be received in any form, including acoustic, speech, or tactile input.

Many of the above-described features and applications are implemented as software processes that are specified as a set of instructions recorded on a computer readable storage medium (also referred to as computer readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, etc. The computer readable media does not include carrier waves and electronic signals passing wirelessly or over wired connections.

In this specification, the term "software" is meant to include firmware residing in read-only memory or applications stored in magnetic storage, which can be read into memory for processing by a processor. Also, in some implementations, multiple software aspects of the subject disclosure can be implemented as sub-parts of a larger program while remaining distinct software aspects of the subject disclosure. In some implementations, multiple software aspects can also be implemented as separate programs. Finally, any combination of separate programs that together implement a software aspect described here is within the scope of the subject disclosure. In some implementations, the software programs, when installed to operate on one or more electronic systems, define one or more specific machine implementations that execute and perform the operations of the software programs.

A computer program (also known as a program, software, software application, script, or code) can be written in any form of programming language, including compiled or interpreted languages, declarative or procedural languages, and it can be deployed in any form, including as a stand alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Some of the blocks may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

The predicate words "configured to", "operable to", and "programmed to" do not imply any particular tangible or intangible modification of a subject, but, rather, are intended to be used interchangeably. For example, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "example" is used herein to mean "serving as an example or illustration." Any aspect or design described herein as "example" is not necessarily to be construed as preferred or advantageous over other aspects or design All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112(f) unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. A sensor assembly for an electronic device, the sensor assembly comprising:

a substrate having an opening configured for alignment with an opening in a housing of the electronic device;

a sensor element mounted on a surface of the substrate in fluid communication with the opening in the substrate and in electrical communication with a plurality of conductive traces on or within the substrate;

a cover sealingly disposed on the surface of the substrate and defining a back chamber for the sensor element between the cover and the surface of the substrate; and an interposer mounted on the surface of the substrate and having a surface that is spaced apart from the surface of the substrate and includes a plurality of electrical contacts coupled to the plurality of conductive traces.

2. The sensor assembly of claim 1, further comprising an application specific integrated circuit that is mounted to the surface of the substrate within the back chamber and that is coupled between the sensor element and the plurality of conductive traces.

3. A sensor assembly for an electronic device, the sensor assembly comprising:

a substrate having an opening configured for alignment with an opening in a housing of the electronic device;

a sensor element mounted on a surface of the substrate in fluid communication with the opening in the substrate and in electrical communication with a plurality of conductive traces on or within the substrate;

a cover sealingly disposed on the surface of the substrate and defining a back chamber for the sensor element between the cover and the surface of the substrate; and an interposer mounted on the surface of the substrate and having a surface that is spaced apart from the surface of the substrate and includes a plurality of electrical contacts coupled to the plurality of conductive traces, wherein the cover extends perpendicularly from the surface of the substrate to a first height above the surface of the substrate, wherein the interposer extends perpendicularly from the surface of the substrate to a second height above the surface of the substrate, and wherein the second height is greater than the first height.

4. The sensor assembly of claim 3, wherein the interposer comprises an elongate interposer body that extends along an outer sidewall of the cover in a direction that is parallel to the surface of the substrate.

5. The sensor assembly of claim 4, wherein the plurality of electrical contacts are spaced apart along an elongate dimension of the elongate interposer body, and disposed at the second height above the surface of the substrate.

6. The sensor assembly of claim 1, wherein the interposer comprises a plurality of conductive vias that are electrically coupled to the plurality of conductive traces and that each extend, perpendicularly to the surface of the substrate, between the surface of the substrate and a corresponding one of the electrical contacts on the surface of the interposer.

7. The sensor assembly of claim 1, further comprising a mesh layer that extends over the opening in the substrate.

8. The sensor assembly of claim 7, wherein the mesh layer comprises a metal mesh, and wherein the sensor assembly further comprises an environmental liquid barrier membrane that extends over the opening in the substrate.

9. The sensor assembly of claim 1, wherein the sensor element is a microelectromechanical systems (MEMS) microphone.

10. The sensor assembly of claim 9, wherein the MEMS microphone comprises a moveable membrane disposed in alignment with the opening in the substrate.

11. An electronic device, comprising:

a housing;

an opening in the housing configured to fluidly couple an environment external to the housing to an interior volume within the housing; and a sensor assembly disposed within the housing, wherein the sensor assembly comprises:

a substrate having an opening that is aligned with the opening in the housing;

a sensor element mounted on a surface of the substrate in fluid communication with the opening in the substrate and in electrical communication with a plurality of conductive traces on or within the substrate;

a cover sealingly disposed on the surface of the substrate and defining a back chamber for the sensor element between the cover and the surface of the substrate; and an interposer mounted on the surface of the substrate and having surface that is spaced apart from the surface of the substrate and includes a plurality of electrical contacts coupled to the plurality of conductive traces;

processing circuitry disposed within the housing for operation of the electronic device; and a flexible printed circuit that is electrically coupled to the plurality of electrical contacts on the surface of the interposer and extends from the interposer to the processing circuitry, wherein the flexible printed circuit comprises a sensor portion that is attached to an outer surface of the cover, a device portion, and a bend portion having a single bend between the sensor portion and the device portion.

12. The electronic device of claim 11, wherein the sensor portion extends beyond an edge of the outer surface of the cover onto the surface of the interposer.

13. The electronic device of claim 12, further comprising a layer of adhesive between the outer surface of the cover and the sensor portion of the flexible printed circuit.

14. The sensor assembly of claim 8, wherein the environmental barrier membrane is disposed between the mesh layer and the substrate.

15. The sensor assembly of claim 14, wherein the mesh layer and the environmental barrier membrane form an environmental barrier that is disposed within a recess in the substrate.

16. The sensor assembly of claim 15, further comprising a sealing material that seals a space between an outer edge of the environmental barrier and an interior edge of the recess in the substrate.

17. The sensor assembly of claim 1, wherein the interposer comprises an elongate interposer body that extends along an outer sidewall of the cover in a direction that is parallel to the surface of the substrate.

18. The sensor assembly of claim 17, wherein the plurality of electrical contacts are spaced apart along an elongate dimension of the elongate interposer body.

19. The sensor assembly of claim 3, wherein the interposer comprises a plurality of conductive vias that are electrically coupled to the plurality of conductive traces and that each extend, perpendicularly to the surface of the substrate, between the surface of the substrate and a corresponding one of the electrical contacts on the surface of the interposer.

20. The sensor assembly of claim 3, further comprising a mesh layer that extends over the opening in the substrate.

21. The sensor assembly of claim 20, wherein the mesh layer comprises a metal mesh, and wherein the sensor assembly further comprises an environmental barrier membrane that extends over the opening in the substrate.

* * * * *